United States Patent [19]

Shaffer

[11] Patent Number: 4,890,205

[45] Date of Patent: Dec. 26, 1989

[54] COMBINED NIGHT LIGHT AND PRE-MOISTENED TOWELLETTE WARMER

[76] Inventor: Dennis E. Shaffer, 1503 N. Weiland Apt. 3R, Chicago, Ill. 60610

[21] Appl. No.: 209,226

[22] Filed: Jun. 20, 1988

[51] Int. Cl.[4] ..... F21V 33/00

[52] U.S. Cl. ..... 362/154; 362/253; 219/214; 221/150 A

[58] Field of Search ..... 219/214, 386, 521; 362/154, 156, 253, 362, 801; 221/150 A

[56] References Cited

U.S. PATENT DOCUMENTS 4,694,973 9/1987 Rose et al. ..... 362/154 X 4,700,048 10/1987 Levy ..... 219/521 X

*Primary Examiner*—Stephen F. Husar

*Attorney, Agent, or Firm*—Michael R. McKenna

[57] ABSTRACT

An apparatus for warming pre-moistened towellettes in a variety of pre-packaged dispensers as presented. The apparatus accommodates both rectangular and cylindrical towellette dispensers and additionally serves as a night light utilizing an incandescent light bulb heating source and translucent body. The apparatus provides a hygienic way to warm pre-moistened towellettes in their pre-packaged dispensers since no part of the apparatus interferes with the access or removal of towellettes from the towellette dispenser opening.

18 Claims, 2 Drawing Sheets

COMBINED NIGHT LIGHT AND PRE-MOISTENED TOWELLETTE WARMER

BACKGROUND OF THE INVENTION

This invention relates to an illuminated apparatus for warming pre-moistened towellettes while in their pre-packaged dispenser.

Recently the marketplace has provided us with a convenient sterile way to clean the human anatomy by means of disposable pre-moistened towellettes. These towellettes have become primarily used for baby cleaning during a diaper change. However, the towellette moistening solution may produce a disquieting effect when the towellette is placed in contact with the baby's skin. This can be eliminated by raising the temperature of the towellettes above room temperature. This invention provides a convenient, inexpensive means to warm the towellettes while maintaining the sterile integrity of the pre-packaged dispenser. Its illumination can also serve as a night light in the baby's room. Unlike the prior art, the invention accommodates both currently marketed cylindrical and rectangular shaped pre-packaged towellette dispensers warms the pre-moistened towellettes while in their pre-packaged dispenser and the sterile integrity of the towellettes is undisturbed by its use.

SUMMARY OF THE INVENTION

This invention warms pre-moistened towellettes in their pre-packaged dispenser and additionally serves as a night light. The warming apparatus accommodates both cylindrically and rectangularly shaped towellette dispensers through the use of a removable container lid. Rectangular dispensers can be used without the removable container lid. Cylindrical dispensers can be accommodated with the container lid in place. It is hygienic in that no part of the warming apparatus comes in contact or interferes with the removal of towellettes from their pre-packaged dispenser. The heating element consists of a low intensity incandescent light bulb and socket which can easily be replaced when required. This invention provides an efficient and inexpensive means to provide an illuminated apparatus to warm pre-moistened towellettes in the cylindrical and rectangular dispensers in which they are marketed while maintaining the sterile integrity of the towellette by not interfering with its removal. These and other features of the invention are more easily understood with reference to the following figures.

DESCRIPTION OF THE PREFERRED EMBODIMENTS

Figure 1:
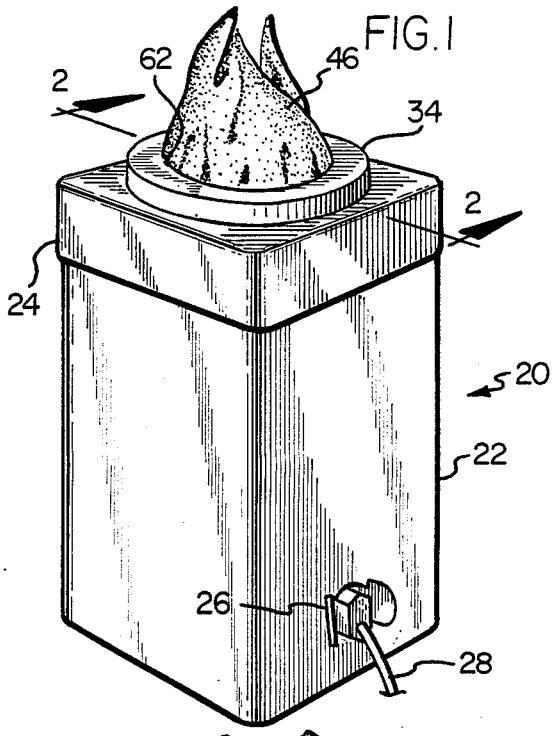
FIG. 1 is a perspective view of a combination night light and pre-moistened towellette warmer with lid in place for use with an inserted cylindrical pre-moistened towellette dispenser in accordance with this invention.
Figure 2:
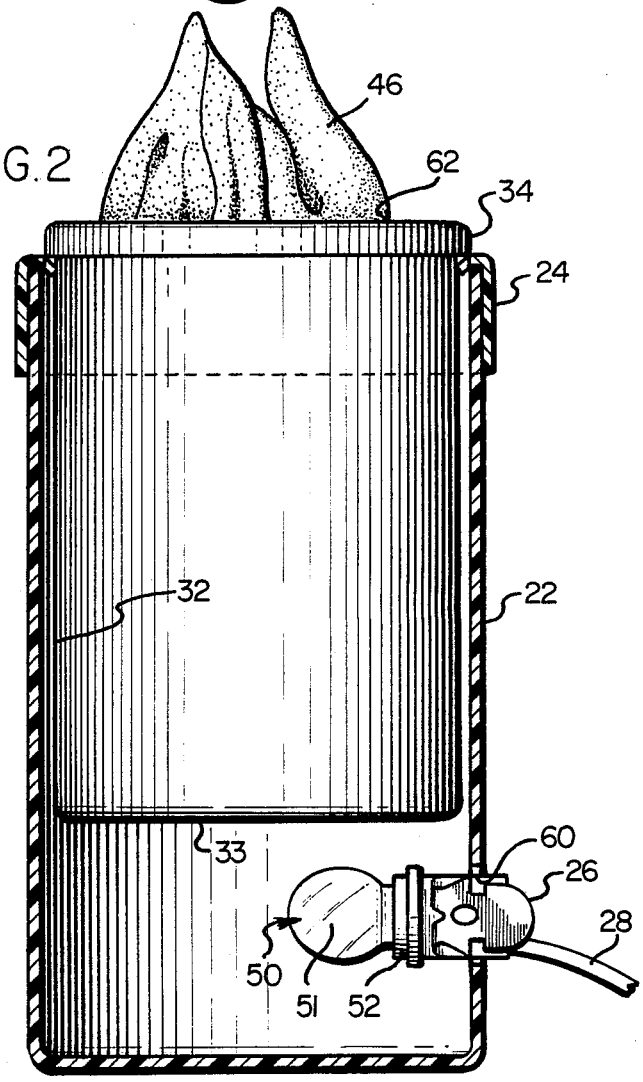
FIG. 2 is a cross sectional view with parts shown in elevation of the combination night light and pre-moistened towellette warmer taken generally in the plane of line 2—2 of FIG. 1.
Figure 3:
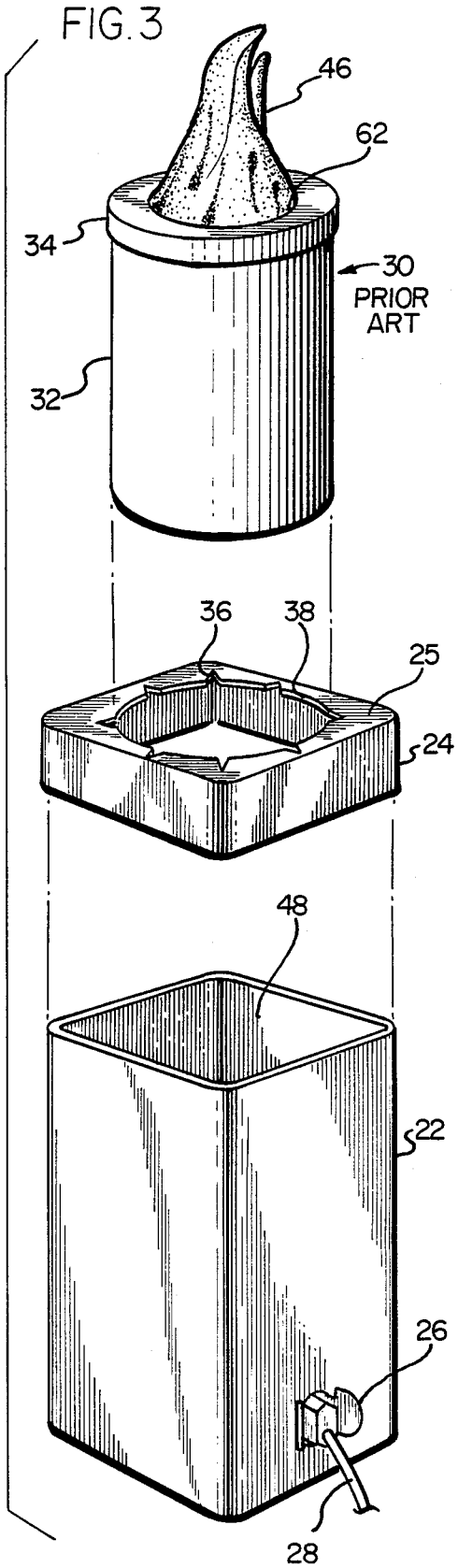
FIG. 3 is a perspective view with extracted parts shown in elevation of a cylindrical pre-moistened towellette dispenser, the container lid and the combination night light and pre-moistened towellette warmer.
Figure 4:
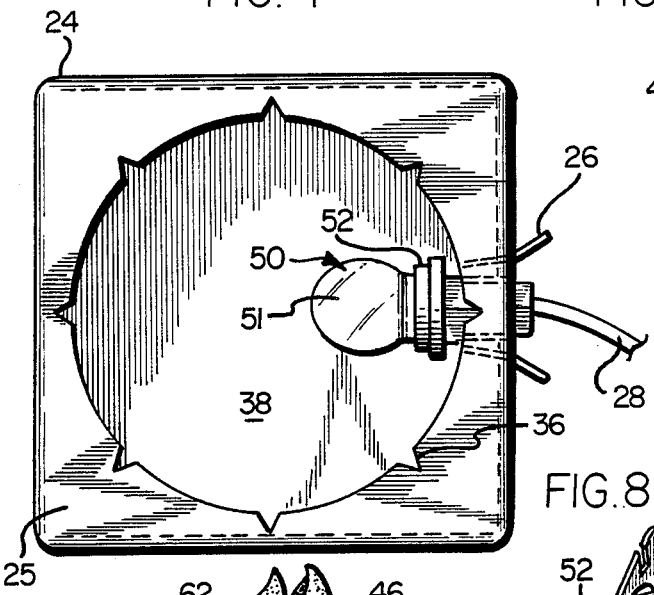
FIG. 4 is a top plan view of the combination night light and pre-moistened towellette warmer with the container lid in place.
Figure 5:
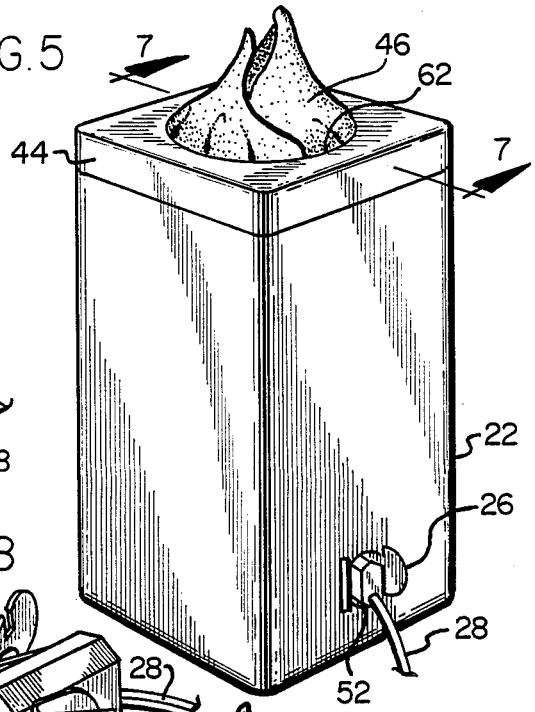
FIG. 5 is a perspective view of the combination night light and pre-moistened towellette warmer with the lid removed and with a rectangular pre-moistened towellette dispenser inserted for use in accordance with this invention.
Figure 8:
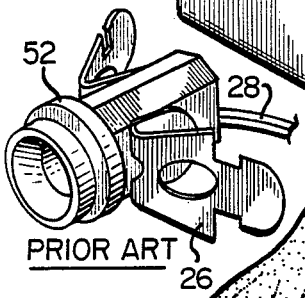
FIG. 8 is a perspective view of the light socket with a mounting clip.
Figure 6:
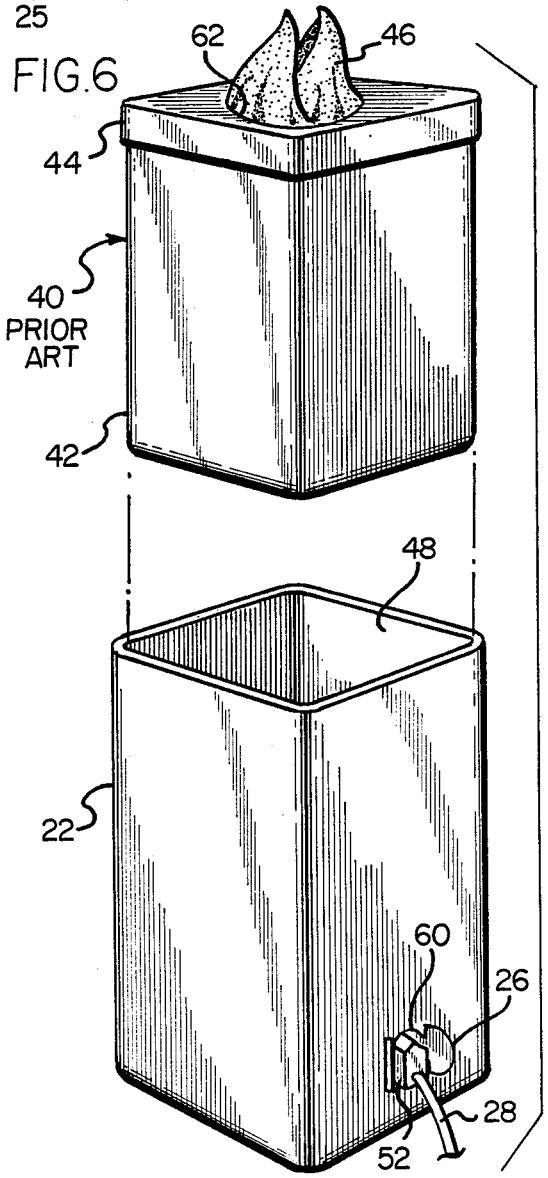
FIG. 6 is a perspective view with extracted parts shown in elevation of a rectangular pre-moistened towellette dispenser and the combination night light and pre-moistened towellette warmer.
Figure 7:
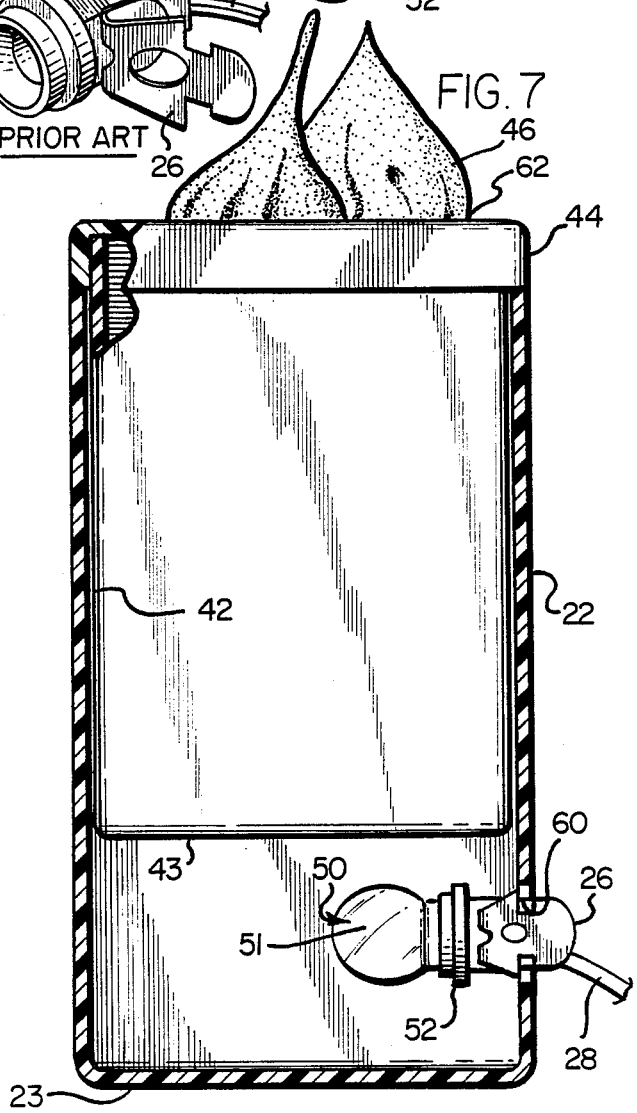
FIG. 7 is a cross sectional view with parts shown in elevation of the combination night light and pre-moistened towellette warmer taken generally in the plane of line 7—7 of FIG. 5.

Referring to the drawing wherein like numerals are used to designate similar parts throughout the several views, numerals 30 and 40, respectively, refer generally to the prior art pre-packaged pre-moistened towellette dispensers with cylindrical and rectangular configurations. The prior art cylindrical dispenser 30 has a tubular body 32 and circular bottom wall 33 with an upper rim 34 containing an opening 62 through which the towellettes 46 are accessibly removed. Similarly, the prior art dispenser 40 is a box like receptacle 42 having a rectangular bottom wall 43 and, an upper rim 40 containing an opening 62 through which the towellettes 46 are accessibly removed. The prior art dispensers have means, not depicted in the drawings, for sealing the towellette opening 62. The combination night light and pre-moistened towellette warmer 20 will accommodate one or more size of rectangular and cylindrical dispensers.

The invention 20 consists of a generally box like container 22, of sufficient height to accommodate a pre-packaged pre-moistened towellette dispenser 30 or 40, which is closed at the bottom 23 and open at the top 48 with an opening 60 positioned in the bottom portion of the container 22 to permit entry and mounting of an electrical heating means 50 with a mounting means 26 and a removable flanged container lid 24. The opening 60 is positioned in the bottom portion of the container 22 so as to preclude interference between the inserted dispenser 30 or 40 and the electrical heating means 50.

The container 22 accepts a rectangular dispenser 40 through the top opening 48 with the rim 44 of the dispenser 40 resting on the top portion of the container 22. The container 22 is adapted for use with cylindrical dispensers 30 by the use of a removable flanged container lid 24. This container lid is open at the bottom to fit over and rest upon the top portion of the container 22 and its top surface 25 contains a generally circular opening 38 augmented by a plurality of fins 36. The fins 36 can protrude out away from the center of the opening 38, as shown, or in toward the center of the opening 38, creating a flexibly rigid top surface 25 to snugly fit a cylindrical dispenser 30.

Due to the fact that the cylindrical dispensers 30 currently marketed have a smaller diameter bottom wall 33 than the diagonal of the bottom wall 43 of the rectangular dispensers 40, the preferred embodiment consists of a box like container 22 to accommodate a larger rectangular dispenser 40 with a removable container lid 24 containing an opening 38 to accommodate the smaller cylindrical dispensers 30. It is understood that the container 22 may have an irregular shape and that the perimeter of the opening 38 in the container lid can vary to accommodate a variety of dispenser shapes.

A metal clip 26 is used to mount the electrical heating means to the opening 60 in the bottom portion of the container 22. The electrical heating means 50 can be an incandescent light bulb 51, a light bulb socket 52 and an electric cord 28. An incandescent light bulb 51 is preferred because the light, in addition to providing resistance heating to the dispenser 30 or 40, also illuminates the translucent container 22 and container lid 24. Thus, the preferred embodiment of this invention warms pre-moistened towellettes 46 in their original pre-packaged dispenser 30 or 40 and serves as a night light.

What is claimed is:

1. An apparatus for warming pre-moistened towellettes in their pre-packaged dispenser comprising:

a container closed at the bottom with an opening at the top suitably sized and adapted to accept the body of a rectangular dispenser where the rim of said dispenser rests on the top portion of the container and with an opening positioned in the bottom portion of the container;

an electrical heating means disposed within the container extending through the opening in the bottom portion of the container;

a removable container lid of suitable size to rest on the top portion of the container containing an opening in the top surface suitably sized and adapted to accept the body of a cylindrical dispenser where the rim of said dispenser rests on the top surface of the container lid; and a means for mounting the electrical heating means to the opening in the bottom portion of the container.

2. The warming apparatus of claim 1 in which the container is of sufficient height to accommodate a pre-packaged pre-moistened towellette dispenser without interference with the electrical heating means.

3. The warming apparatus of claim 2 in which the container is box-like in shape.

4. The warming apparatus of claim 2 wherein the electrical heating means consisting of an incandescent light bulb, a light bulb socket and an electric cord.

5. The warming apparatus of claim 4 wherein the container and container lid are made from a translucent material so that the apparatus also serves as a night light.

6. The combination night light and warming apparatus of claim 5 wherein the container lid has a flanged lip extending downward over the container when in place.

7. The combination night light and warming apparatus of claim 6 wherein the top surface of the container lid contains an irregular perimeter for the opening to provide a flexibly rigid snug fit between the top surfaces of the lid and the towellette dispenser.

8. The combination night light and warming apparatus of claim 7 wherein the irregular perimeter for the opening is generally circular augmented by a plurality of fins.

9. The combination night light and warming apparatus of claim 8 wherein the means for mounting the electrical heating means to the opening in the bottom portion of the container is a metal clip.

10. The combination night light and warming apparatus of claim 9 wherein the container has a box-like shape.

11. The combination night light and warming apparatus of claim 2 wherein the container lid is attached to the container by a flexible attachment means.

12. The combination night light and warming apparatus of claim 10 wherein the container and lid are constructed of polymers.

13. An apparatus for warming pre-moistened towellettes in their pre-packaged dispenser made from a translucent material so that the apparatus also serves as a night light, comprising:

a container, of sufficient height to accommodate a pre-packaged pre-moistened towellette dispenser without interference with an electrical heating means, which is closed at the bottom with an opening at the top suitably sized and adapted to accept the body of a rectangular dispenser where the rim of said dispenser rests on the top portion of the container and with an opening positioned in the bottom portion of the container;

an electrical heating means consisting of an incandescent light bulb, a light bulb socket and an electric cord, disposed within the container extending through the opening in the bottom portion of the container;

a removable container lid, of suitable size to rest on the top portion of the container with a flanged lip extending downward over the container when in place and which contains an irregular perimeter opening to provide a flexibly rigid snug fit, which is suitably sized and adapted to accept the body of a cylindrical dispenser with the rim of said dispenser resting on the top surface of the container lid; and a means for mounting the electrical heating means to the opening in the bottom portion of the container.

14. The combination night light and warming apparatus of claim 13 wherein the irregular perimeter opening of the container lid is generally circular augmented by a plurality of fins.

15. The combination night light and warming apparatus of claim 14 wherein the means for mounting the electrical heating means to the opening in the bottom portion of the container is a metal clip.

16. The combination night light and warming apparatus of claim 15 wherein the container has a box-like shape.

17. The combination night light and warming apparatus of claim 15 wherein the container and lid are constructed of polymers.

18. An apparatus for warming pre-moistened towellettes in their pre-packaged dispenser comprising:

a container closed at the bottom with an opening at the top suitably sized and adapted to accept the body of a rectangular dispenser where the rim of said dispenser rests on the top portion of the container and with an opening positioned in the bottom portion of the container;

an electrical heating means disposed within the container extending through the opening in the bottom portion of the container; and a means for mounting the electrical heating means to the opening in the bottom portion of the container.

* * * * *